US007198340B1

(12) United States Patent
Ertz

(10) Patent No.: US 7,198,340 B1
(45) Date of Patent: Apr. 3, 2007

(54) ARTICLE RETAINER ASSEMBLY FOR REFRIGERATORS

(75) Inventor: Lawrence J. Ertz, Amana, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 11/390,387

(22) Filed: Mar. 28, 2006

(51) Int. Cl.
*A47B 96/02* (2006.01)

(52) U.S. Cl. ..... 312/408; 211/119.003

(58) Field of Classification Search ..... 312/401, 312/405.1, 408, 410, 291; 62/377, 382; 211/134, 211/149, 153, 119.003; 108/6
See application file for complete search history.

(56) References Cited

U.S. PATENT DOCUMENTS

| | | | | |
|---|---|---|---|---|
| 2,074,785 | A | 3/1937 | Gentz | |
| 2,091,607 | A | 8/1937 | Nave | |
| 2,319,470 | A | 5/1943 | Nobles | |
| 2,434,117 | A | 1/1948 | Money et al. | |
| 2,757,061 | A | 7/1956 | Anderson | |
| 2,767,042 | A * | 10/1956 | Kesling | 312/313 |
| 2,828,178 | A | 3/1958 | Daiilgren | |
| 2,976,101 | A | 3/1961 | Rooney | |
| 3,388,808 | A | 6/1968 | Radek | |
| 3,625,371 | A | 12/1971 | Dill | |
| 3,851,765 | A | 12/1974 | Cox | |
| 4,437,572 | A | 3/1984 | Hoffman | |
| 4,492,169 | A | 1/1985 | Ware et al. | |
| 4,500,147 | A | 2/1985 | Reister | |
| 4,610,491 | A | 9/1986 | Freeman | |
| 5,513,910 | A * | 5/1996 | Ellingwood et al. | 312/405.1 |
| 5,567,029 | A | 10/1996 | Haenisch et al. | |
| 6,220,684 | B1 | 4/2001 | Bent et al. | |
| 6,390,310 | B1 | 5/2002 | Insalaco | |
| 6,799,818 | B2 * | 10/2004 | Ahmed et al. | 315/405.1 |
| 6,997,526 | B2 | 2/2006 | Leimkuehler et al. | |
| 7,111,914 | B2 * | 9/2006 | Avendano | 312/405.1 |
| 2005/0082956 | A1 | 4/2005 | Leistner et al. | |

FOREIGN PATENT DOCUMENTS

| | | |
|---|---|---|
| GB | 2099124 | 12/1982 |

* cited by examiner

*Primary Examiner*—James O. Hansen
(74) *Attorney, Agent, or Firm*—Diederiks & Whitelaw PLC

(57) ABSTRACT

An article retainer assembly for a refrigerator shelf includes a pair of support brackets and a retaining member. The support brackets are preferably mounted to opposing side portions of a compartment liner, with the retaining member extending therebetween and across a front edge section of the refrigerator shelf. The support brackets include corresponding guide tracks having first, second and third portions that correspond to upright, lowered and stowed configurations of the retaining member. In the upright position, the retaining member limiting articles resting upon the shelf from moving beyond the front edge section. In the lowered position, the retaining member is positioned to allow unobstructed access to the articles on the shelf and, in the stowed position, the retaining member is held in place below the shelf.

26 Claims, 3 Drawing Sheets

ARTICLE RETAINER ASSEMBLY FOR REFRIGERATORS

BACKGROUND OF THE INVENTION

1. Field of the Invention

The present invention pertains to the art of refrigerators and, more particularly, to a movable front retainer assembly for a refrigerator shelf.

2. Discussion of the Prior Art

It is known to provide a refrigerator shelf with a tilt-down front retaining member. It is also known to provide a freezer shelf with a retaining member that can be shifted from an article retaining position to allow enhanced access to articles on the shelf. Therefore, such front retainers securely retain articles on the shelves, while also providing a user easy access. In most cases, the retaining member is pivoted forward from an initial, upright position, to a second or lowered position. Although useful from an organizational standpoint, when in the lowered position, the retaining member may block a user from readily accessing items stored on lower shelves. In most cases, a special liner construction is required in order to accommodate this type of retaining member. That is, the liner is generally provided with structure designed to hold the retaining member in the upright position.

Other retaining members are removable and, when installed, can be pivoted from an upright position to a lowered position wherein the retaining member is substantially coplanar with the shelf. This type of retaining member allows a user to configure the retaining member to establish a conventional flat shelf or, alternatively, define product retaining structure. However, retaining members of this type generally project beyond the shelf when moved to the lowered position, often preventing the refrigerator door from closing properly and/or damaging the door if it is closed.

Regardless of these known arrangements, there is still a need in the art for an enhanced shelf retaining member. More specifically, there exists a need for a shelf retaining member that can be employed to retain articles on a shelf or be stowed for later use while still providing sufficient clearance for closing a refrigerator door and allowing access to articles located below the shelf. Furthermore, there exists a need for a retaining member that is easily installed into pre-existing refrigerator structures.

SUMMARY OF THE INVENTION

The present invention is directed to an article retainer assembly for a shelf in a refrigerator including a cabinet shell within which is positioned a liner having top, bottom and opposing side walls that define, at least in part, a refrigerated compartment. The shelf is positioned in the refrigerated compartment for supporting articles to be refrigerated. The shelf includes a generally upper planar portion defined, at least in part, by a front edge section. In accordance with the invention, the article retainer assembly extends between the opposing side walls, across the front edge section of the shelf. More specifically, the article retainer assembly includes a pair of support brackets mounted to the opposing side walls of the liner and a retaining member. The retaining member can be readily shifted between an upright position, a lowered position and a stowed position. In the upright position, the retaining member blocks the articles supported on the shelf from moving beyond the front edge section. In the lowered position, the retaining member exposes the articles on the shelf, allowing for easy retrieval by a consumer. When not needed. the retaining member is shifted to the stowed position wherein the retaining member is held under the upper planar portion for later use.

In further accordance with the invention, each of the support brackets includes a guide track. The guide track includes first, second and third portions that correspond to the upright, lowered and stowed positions. More specifically, the retaining member is provided with first and second support elements that project laterally outward from the retaining member into the guide track of corresponding ones of the support brackets. In addition, at least one of the support brackets includes a clip element that cooperates with the retaining member. The clip element holds the retaining member adjacent an underside of the shelf when in the stowed position.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
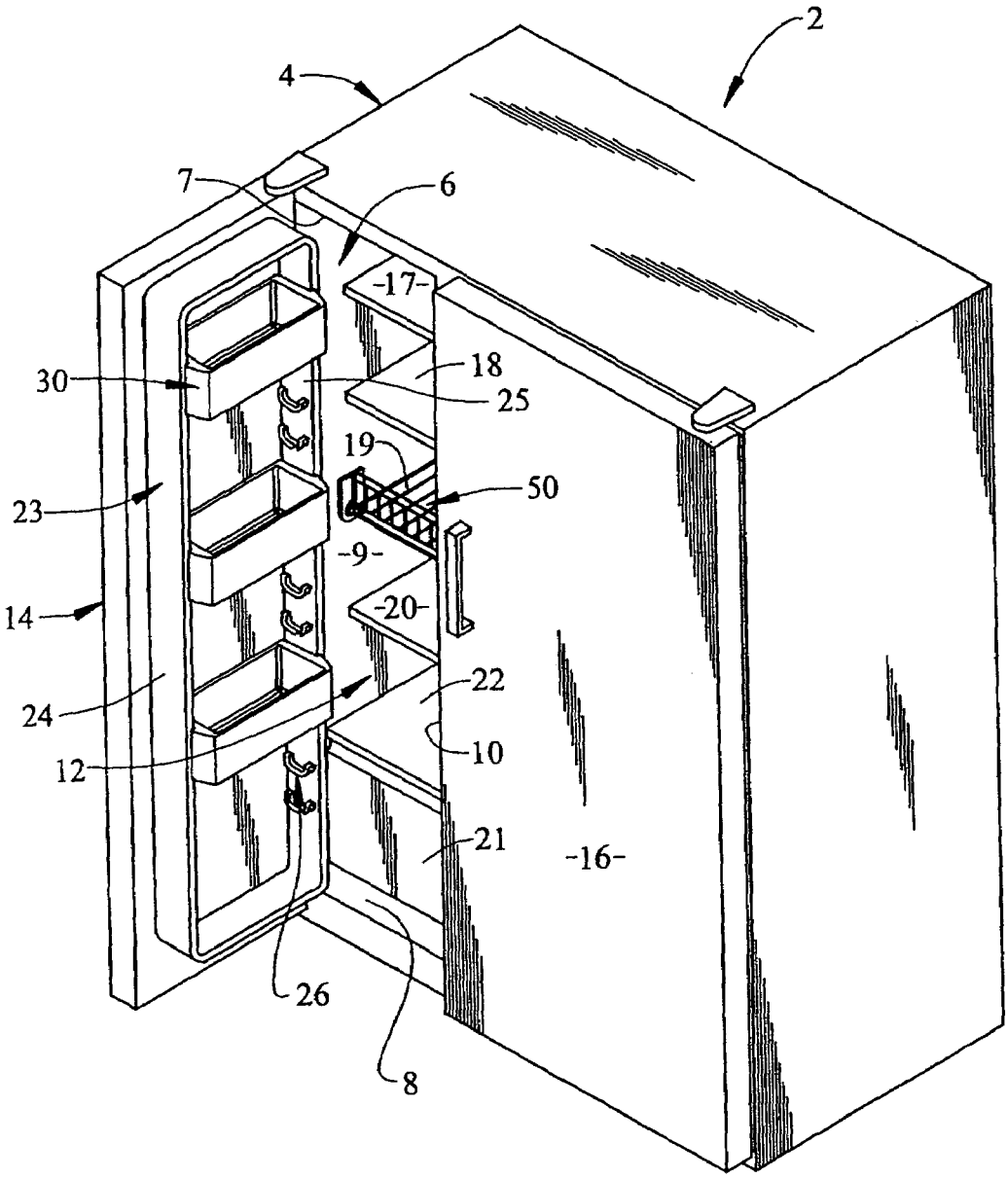
FIG. 1 is an upper left perspective view of a side-by-side refrigerator including an article retaining assembly positioned across a freezer compartment shelf in accordance with the present invention.

With initial reference to FIG. 1, a side-by-side refrigerator 2 includes a cabinet shell 4 within which is positioned a liner 6 having top, bottom and opposing side walls 7–10 that define, at least in part, a freezer compartment 12. In a manner known in the art, freezer compartment 12 can be accessed by the selective opening of a freezer door 14. In a similar manner, a fresh food door 16 can be opened to access a fresh food compartment (not shown). As illustrated in FIG. 1, freezer compartment 12 is provided with a plurality of vertically adjustable spaced shelves 17–20, along with a slidably mounted bin 21 supported below a stationary shelf 22. Also illustrated is a freezer door liner 23 including dike portions 24 and 25 formed with vertically spaced mounting supports, one of which is indicated at 26. Mounted between dike portions 24 and 25 and suspended by supports 26 are a plurality of pick-off bucket assemblies, one of which is indicated at 30. In general, the basic structure of refrigerator 2 described above is known in the art and presented only for the sake of completeness.

Figure 2:
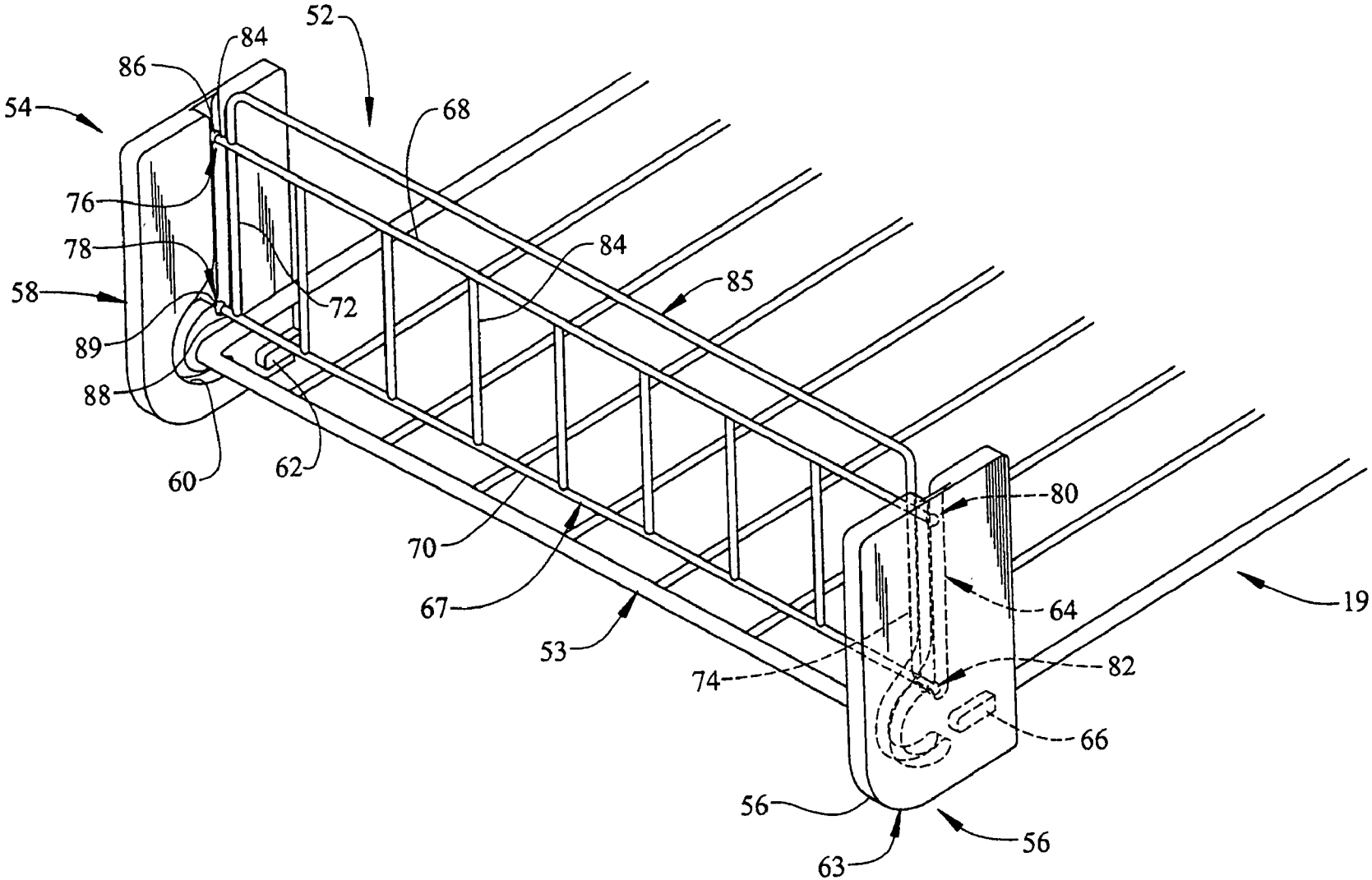
FIG. 2 is an upper left perspective view of the article retainer assembly of FIG. 1, illustrating first and second support brackets and a retaining member of the retaining assembly.

As best shown in FIGS. 1 and 2, shelf 19 is provided with an article retainer assembly 50 including a retaining member 52 that extends across a front edge section 53 of shelf 19 and is supported by first and second support brackets 54 and 56 which are secured to opposing side walls 9 and 10 respectively. Support brackets 54 and 56 can be mounted with, for example, adhesive pads, glue, mechanical fasteners or the like. In accordance with the invention, first bracket 54 includes a main body portion 58, having formed thereon a guide track 60, and a holding element 62. Preferably, guide track 60 is recessed into main body portion 58, while holding element 62 projects laterally outward therefrom. Likewise, second bracket 56 includes a main body portion 63 having formed therein a corresponding guide track 64 and a holding element 66. In the embodiment shown, shelf 19 is formed from a plurality of wire elements (not separately labeled). However, it should be understood that shelf 19 could also be solid, such as by being formed from plastic and/or glass.

In further accordance with the invention, retaining member 52 is preferably formed from coated wire and includes a main body portion 67 having a top section 68, a bottom section 70 and first and second opposing side sections 72 and 74. Retaining member 52 includes a first guide element 76 that projects from top section 68 beyond side section 72 and a pivot post 78 that extends from bottom section 70 beyond side section 72. Retaining member 52 also includes a second guide element 80 that projects from top section 68 beyond side section 74 and a second pivot post 82 that extends from bottom section 70 beyond side section 74. Guide elements 76 and 80 and pivot posts 78 and 82 project into and travel along guide tracks 60 and 64 respectively in a manner that will be discussed more fully below.

In the embodiment shown, retaining member 52 is shown to include a plurality of intermediate members, such as indicated at 84, that extend between and interconnect top and bottom sections 68 and 70. Retaining member 52 is also shown to include an upper U-shaped bar 85. In any event, it should be understood that guide elements 76 and 80, pivot posts 78 and 82 and guide tracks 60 and 64 are respectively, similarly constructed such that a discussion will continue with respect to guide element 76, pivot post 78 and guide track 60 with an understanding that the opposing guide element 80, pivot post 82 and guide track 64 are similarly arranged. As shown, guide element 76 includes a shaft portion 84 that terminates in a head portion 86, with head portion 86 nesting within guide track 60. Likewise, pivot post 78 includes a shaft portion 88 which terminates in a head portion 89 which also nests within guide track 60. In a manner that will be discussed more fully below, guide element 76 and pivot post 82 transition along guide track 60, allowing retaining member 52 to be selectively shifted between a first or upright position as represented in FIGS. 2–4, a second or lowered position as represented in FIG. 5, and a third or stowed position as represented in FIG. 6.

Reference will now be made to FIGS. 3–6 in describing a preferred construction of guide track 60. In order to provide for the transitioning of retaining member 52, guide track 60 is formed with first, second and third portions 100, 102 and 104. First portion 100 includes a first end 110 that extends to a second end 111 through an intermediate portion 112. As will be discussed more fully below, first end 110 is exposed at an upper portion (not separately labeled) of support bracket 54. Second portion 102 extends from and actually connects with first portion 100. Towards that end, second portion 102 is provided with a first end 116 that extends towards a second end 118 through an arcuate intermediate portion 120. Preferably, first end 116 is positioned at a point off-set from second end 111 of first portion 100 such that second end 111 actually defines a notch. This configuration ensures that, as will be discussed more fully below, guide element 76 and pivot post 78 must initially be raised upward along first portion 100 before pivot post 78 can enter into second portion 102. Finally, third portion 104 is actually a terminal end section or continuation of second end 118. As illustrated, first portion 100, second portion 102 and third portion 104 are directly interconnected. By interconnected, it should be understood that first portion 100, second portion 102 and third portion 104 form a continuous path.

Figure 3:
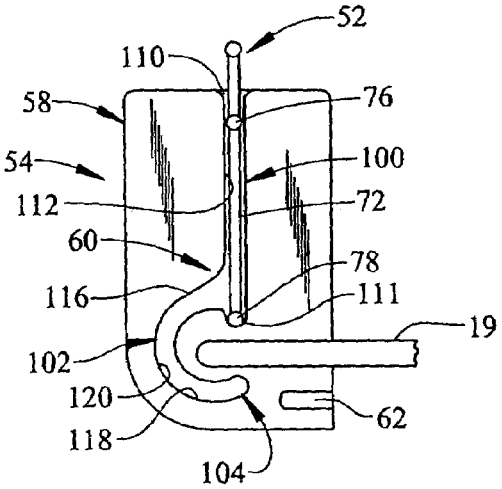
FIG. 3 is a side elevational view of one support bracket of the article retainer assembly illustrating the retaining member in a first or upright position.
Figure 4:
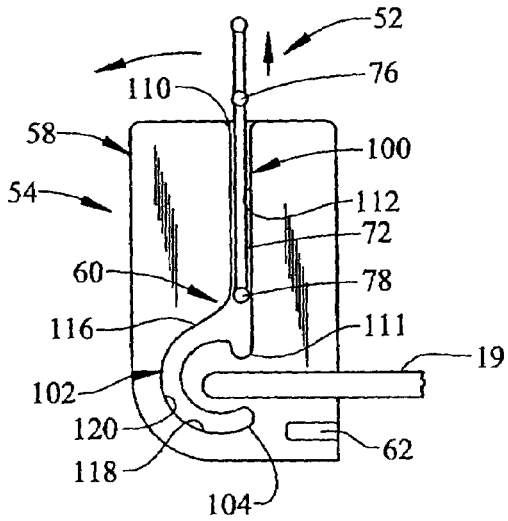
FIG. 4 is a side elevational view of one support bracket of the article retainer assembly illustrating the retaining member shifting towards a second or lowered position.
Figure 5:
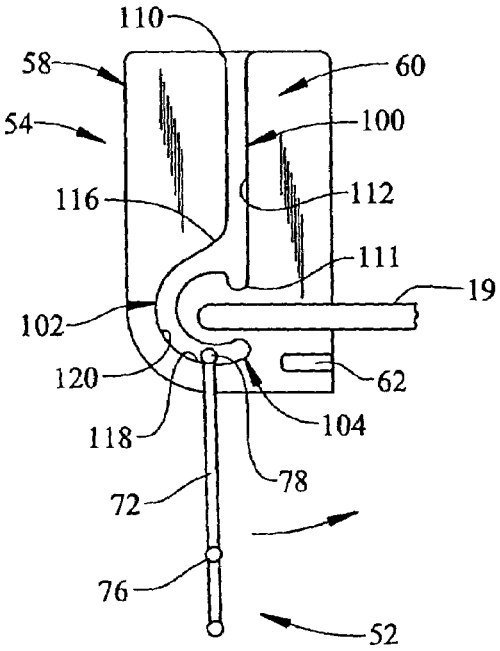
FIG. 5 is a side elevational view of one support bracket of the article retainer assembly illustrating the retaining member in the second or lowered position.

Having described a preferred structure of article retainer assembly 50, reference will continue to FIGS. 3–6 in describing a preferred method of operation. As best shown in FIG. 3, retaining member 52 is shown in a first or upright position. In the upright position, retaining member 52 is positioned substantially perpendicular to shelf 19 so as to effectively block or prevent articles resting upon shelf 19 from moving beyond front edge portion 53. In order to remove an article from shelf 19, a consumer need simply shift retaining member 52 from the upright position to a lowered position as detailed below. More specifically, retaining member 52 is initially raised within first portion 100 of guide track 60 as represented in FIG. 4 such that guide element 76 moves beyond or out from first end 110 and pivot post 78 is unseated from the notch established by second end 111. At this point, retaining member 52 is rotated outward, followed by pivot post 78 traveling along second portion 102 until reaching second end 118. At this point, as shown in FIG. 5, retaining member 52 simply hangs substantially perpendicularly downward from shelf 16, allowing a consumer to readily retrieve any desired articles. To return retaining member 52 to the upright position, a consumer need merely reverse the above described process, shifting retaining member 52 along second portion 120 in order to allow guide element 76 to move back into first end 110 until pivot post 78 again rests in the notch defined by second end 111.

Figure 6:
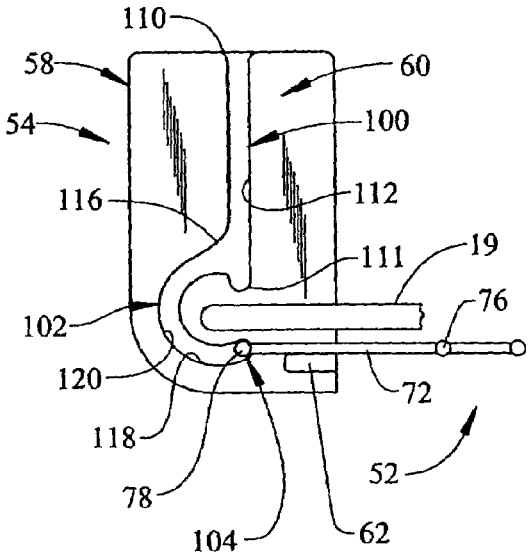
FIG. 6 is a side elevational view of one support bracket of the article retainer assembly illustrating the retaining member in a final or stowed position.

In the event that a consumer does not wish to utilize retainer assembly 50, retaining member 52 can be shifted to the third or stowed position as represented in FIG. 6. More specifically, in the manner described above, retaining member 52 is initially raised such that guide element 76 shifts out from first end 110 of first portion 100 and pivot element 78 shifts to a position adjacent first end 116 of second portion 102. At this point, retaining member 52 is rotated forward, with pivot post 78 traveling within second portion 102. However, instead of simply hanging downward at third end 118 as shown in FIG. 5, retaining member 52 is further shifted upward and rearward so as to be substantially coplanar with shelf 16 as represented in FIG. 6. At this point, side portion 72 snaps over and abuts with holding element 62 to hold retaining member 52 in the stowed position.

Based on the above description, it should be understood that the present invention provides for a unique, cost effective means of providing an article retainer assembly without the need to make structural changes to refrigerator 6. That is, support brackets 54 and 56 can simply be mounted to opposing side walls of a refrigerator liner with, for example, adhesive or mechanical fasteners, and retaining member 52 supported there between. That is, retaining assembly 50 can be employed both as an initial production version and as an aftermarket add-on or retrofit to existing refrigeration appliances. Moreover, the present invention provides for an easy to use and readily re-positionable article retaining arrangement that can be employed by a consumer to prevent articles from shifting off of refrigerator compartment shelves or, if so desired, be stowed away for later use.

Although described with reference to a preferred embodiment of the invention, it should be readily understood that various changes and/or modifications can be made to the invention without departing from the spirit thereof. For instance, although the brackets are shown attached to the liner of a refrigerator compartment, the brackets may attach directly to or integrally formed with a shelf unit. In addition, it is envisioned that the holding element may be in some other form, such as a ball detent, a spring element, or the like. Furthermore, while shown in connection with a freezer shelf, the retaining assembly could also be employed in a fresh food compartment or, for that matter, on a door mounted shelf-bin. In general, the invention is only intended to be limited by the scope of the following claims.

I claim:

1. A refrigerator comprising:

a cabinet;

a liner arranged within the cabinet, said liner having top, bottom and opposing side walls defining, at least in part, a refrigerated compartment;

a door pivotally mounted relative to the cabinet for selectively closing the refrigerated compartment;

a shelf mounted in the refrigerator compartment for supporting articles to be refrigerated, said shelf including a substantially flat planar portion defined, at least in part, by a front edge section; and an article retainer assembly extending between the opposing side walls across the front edge section of the shelf, said article retaining assembly including:

first and second support brackets mounted at the front edge section of the shelf, each of said first and second support brackets including a guide track; and a retaining member positioned across the front edge section of the shelf, said retaining member including a main body portion having first and second end sections, each of said first and second end sections being provided with a support element extending into the guide track of a respective one of the first and second support brackets, said support element being adapted to transition along the guide track when shifting the retaining member between three distinct positions including a first position wherein the retaining member extends above the front edge section of the shelf to block articles on the shelf, a second position wherein the retaining member is lowered to expose articles stored on the shelf, and a third, stowed position wherein the retaining ember is maintained in a location assuring unobstructed access to articles stored on the shelf.

2. The refrigerator according to claim 1, wherein the guide track includes a first portion, a second portion and a third portion.

3. The refrigerator according to claim 2, wherein the first, second and third portions of the guide track are directly interconnected so as to define a continuous path.

4. The refrigerator according to claim 2, wherein the first portion of the guide track includes a first end that extends to a second end through an intermediate portion, said second end defining a notch.

5. The refrigerator according to claim 4, wherein the support element rests within the notch when the retaining member is in the first position.

6. The refrigerator according to claim 2, wherein the second portion of the guide track includes an arcuate section.

7. The refrigerator according to claim 1, wherein the support element defines a pivot element for the retaining member.

8. The refrigerator according to claim 7, further comprising: a guide element extending laterally outward from each of the first and second end sections of the retaining member, said guide element being spaced from the pivot member and extending into a respective said guide track only when the retaining member is in the first position.

9. The refrigerator according to claim 1, wherein the first and second support brackets are directly mounted to respective ones of the opposing side walls of the liner.

10. The refrigerator according to claim 1 wherein, when in the stowed position, said retaining member extends below and substantially parallel to the substantially flat planar portion of the shelf.

11. The refrigerator according to claim 1, wherein the article retaining assembly further includes a holding element for selectively maintaining the retaining member in the stowed position.

12. A refrigerator comprising:

a cabinet;

a liner arranged within the cabinet, said liner having top, bottom and opposing side walls defining, at least in part, a refrigerated compartment;

a door pivotally mounted relative to the cabinet for selectively closing the refrigerated compartment;

a shelf mounted in the refrigerator compartment for supporting articles to be refrigerated, said shelf including a substantially flat planar portion defined, at least in part, by a front edge section; and an article retainer assembly extending between the opposing side walls across the front edge section of the shelf, said article retaining assembly including:

a retaining member positioned across the front edge section of the shelf, said retaining member including a main body portion having first and second end sections, said retaining member between shiftably mounted relative to the shelf in three distinct positions including a first position wherein the retaining member extends above the front edge section of the shelf to block articles on the shelf, a second position wherein the retaining member is lowered to expose articles stored on the shelf, and a third, stowed position wherein the retaining ember is maintained in a location assuring unobstructed access to articles stored on the shelf; and means for supporting the retaining member in each of the first, second and third positions, said supporting means being provided at the front edge section of the shelf.

13. The refrigerator according to claim 12, wherein supporting means includes a guide track, said guide track having a first portion, a second portion and a third portion.

14. The refrigerator according to claim 13, wherein the first, second and third portions of the guide track are directly interconnected so as to define a continuous path.

15. The refrigerator according to claim 13, wherein the retaining member includes at least one support element that projects laterally outward from one of the first and second end sections into the guide track.

16. The refrigerator according to claim 15, wherein the first portion of the guide track includes a first end that extends to a second end through an intermediate portion, said second end defining a notch.

17. The refrigerator according to claim 16, wherein the support element rests within the notch when the retaining member is in the first position.

18. The refrigerator according to claim 15, further comprising: at least one guide element extending laterally outward from the one of the first and second end sections of the retaining member, said guide element being spaced from the at least one support element and extending into the guide track only when the retaining member is in the first position.

19. The refrigerator according to claim 13, wherein the second portion of the guide track includes an arcuate section.

20. The refrigerator according to claim 13, wherein the supporting means is constituted by first and second support brackets, each of said first and second support brackets including a corresponding guide track.

21. The refrigerator according to claim 20, wherein the first and second support brackets are directly mounted to respective ones of the opposing side walls of the liner.

22. The refrigerator according to claim 12 wherein, when in the stowed position, said retaining member extends below and substantially parallel to the substantially flat planar portion of the shelf.

23. The refrigerator according to claim 12, wherein the article retaining assembly further includes a holding element for selectively maintaining the retaining member in the stowed position.

24. A method of operating an article retaining assembly provided across a front edge section of a refrigerator shelf comprising:

positioning a retaining member in a first position to prevent articles on a refrigerator shelf from shifting beyond a front edge section;

lifting the retaining member, causing a pivot element to shift from a first portion of a guide track to a position adjacent a second portion of the guide track;

rotating the pivot element into the second portion of the guide track causing the retaining member to shift outward from the shelf to a second position; and selectively stowing the retaining member in a third position wherein the retaining member is supported below and substantially parallel to the shelf.

25. The method of claim 24, wherein the pivot element must be lifted out of a notch in order to shift the pivot element from the first portion of the guide track to the position adjacent the second portion of the guide track.

26. The method of claim 24, wherein the retaining member is snap-fittingly retained in the third position.

* * * * *